US006040269A

United States Patent [19]

Imoto et al.

[11] Patent Number: 6,040,269

[45] Date of Patent: Mar. 21, 2000

[54] METHOD FOR FORMING IMAGE ON OBJECT AND THERMAL TRANSFER SHEET AND THERMAL TRANSFER IMAGE-RECEIVING SHEET FOR USE IN SAID METHOD

[75] Inventors: Kazunobu Imoto; Katsuyuki Oshima; Hideki Nishikawa, all of Tokyo-To, Japan

[73] Assignee: Dai Nippon Printing Co., Ltd., Japan

[21] Appl. No.: 09/009,944

[22] Filed: Jan. 21, 1998

Related U.S. Application Data

[62] Division of application No. 08/406,138, Mar. 20, 1995, Pat. No. 5,741,754.

[30] Foreign Application Priority Data

Mar. 18, 1994 [JP] Japan ..... 6-72962
Mar. 18, 1994 [JP] Japan ..... 6-72963

[51] Int. Cl.[7] ..... B41M 5/035; B41M 5/38

[52] U.S. Cl. ..... 503/227; 428/195; 428/480; 428/913; 428/914

[58] Field of Search ..... 8/471; 428/195, 428/913, 914, 480; 503/227

[56] References Cited

U.S. PATENT DOCUMENTS

| | | | |
|---|---|---|---|
| 4,992,414 | 2/1991 | Kishida et al. | 503/227 |
| 5,077,263 | 12/1991 | Henzel | 503/227 |
| 5,093,309 | 3/1992 | Hart et al. | 503/227 |
| 5,132,277 | 6/1992 | Kaszczuk et al. | 503/227 |
| 5,252,535 | 10/1993 | Martin et al. | 503/227 |
| 5,567,669 | 10/1996 | Harada et al. | 503/227 |
| 5,635,440 | 6/1997 | Eguchi et al. | 503/227 |

FOREIGN PATENT DOCUMENTS

| | | | |
|---|---|---|---|
| 0 270 677 | 6/1988 | European Pat. Off. . | |
| 0 365 392 | 4/1990 | European Pat. Off. | 503/227 |
| 0 455 213 | 11/1991 | European Pat. Off. . | |
| 0 467 141 | 1/1992 | European Pat. Off. . | |
| 0 529 537 | 3/1993 | European Pat. Off. . | |
| 0 535 718 | 4/1993 | European Pat. Off. . | |
| 60-203494 | 10/1985 | Japan . | |
| 61-227092 | 10/1986 | Japan | 503/227 |
| 62-66997 | 3/1987 | Japan . | |
| 62-255187 | 11/1987 | Japan . | |
| 62-255188 | 11/1987 | Japan . | |

*Primary Examiner*—Bruce H. Hess
*Attorney, Agent, or Firm*—Parkhurst & Wendel, L.L.P.

[57] ABSTRACT

A thermal transfer sheet includes a support and, provided thereon, at least a yellow dye-holding layer, a magenta dye-holding layer, and a cyan dye-holding layer, the dye-holding layers each including a thermal transfer dye and a binder resin, the yellow dye-holding layer includes as the thermal transfer dye, a dye represented by the following formula 1 and/or a dye represented by the following formula 2, the magenta dye-holding layer includes as the thermal transfer dye, a dye represented by the following formula 3 and at least one dye selected from those represented by the following formulae 4 and 5; and the cyan dye-holding layer includes as the thermal transfer dye, a dye represented by the following formula 6:

Formula 1

Formula 2

-continued
Formula 3
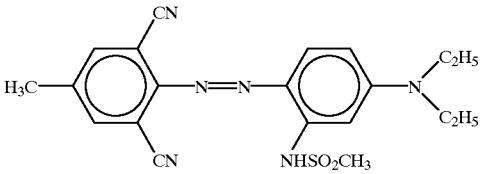
Formula 4
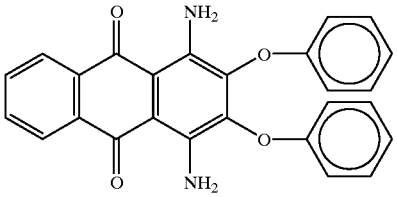
-continued
Formula 5
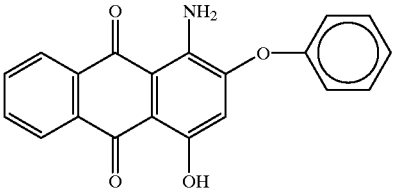
Formula 6
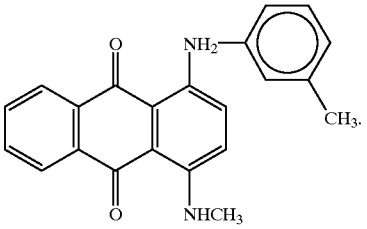
4 Claims, 3 Drawing Sheets

METHOD FOR FORMING IMAGE ON OBJECT AND THERMAL TRANSFER SHEET AND THERMAL TRANSFER IMAGE-RECEIVING SHEET FOR USE IN SAID METHOD

This is a Division of application Ser. No. 08/406,138 filed Mar. 20, 1995, now U.S. Pat. No. 5,741,754.

BACKGROUND OF THE INVENTION

1. Field of the Invention

This invention relates to a method for forming an image on an object utilizing a thermal dye transfer system. This invention also relates to a thermal transfer sheet and a thermal transfer image-receiving sheet for use in said method.

2. Background Art

Various thermal transfer recording systems are known in the art, and one of them is a thermal dye transfer system using as a colorant the so-called sublimable dye which is sublimated or diffused upon exposure to heat. In this system, a thermal transfer sheet is used wherein a dye-holding layer comprising a sublimable dye held in a binder resin is provided on one side of a support such as a polyester film. The thermal transfer sheet is prepared by printing or coating, on a heat resisting support, an ink or a coating solution comprising a mixture of a binder resin with a sublimable dye and drying the resultant coating or print.

The thermal transfer sheet is subjected to selective heating from the back side thereof in a printer having heating means, such as a thermal head, to form an image on a thermal transfer image-receiving sheet comprising a substrate sheet and a dye-receptive layer dyable with a dye.

The dye image thus formed, since a dye is used as the colorant, has excellent sharpness and transparency, offering excellent color reproduction and half tone reproduction. By virtue of this nature, the thermal dye transfer system is suitable for the reproduction of a full-color image, wherein many color dots of three or four colors are transferred onto a thermal transfer image-receiving sheet, and can form an image having a high quality comparable to that formed by the conventional offset printing or gravure printing and a full-color photographic image. For the above reasons, the thermal dye transfer system is convenient for easily providing a full-color hard copy of a computer generated or processed image and a video image in a very short time and in fact has been widely used for this purpose.

Due to the structure or mechanism of a printer, however, it is very difficult to form a dye image directly on an object other than a sheet-form object like a thermal transfer image-receiving sheet. This has led to an attempt to produce a dye image using the above thermal transfer sheet on an object having any desired shape other than sheet.

For example, Japanese Patent Laid-Open Nos. 66997/1987 and 203494/1985 propose a method wherein a thermal transfer image-receiving sheet with a dye image formed thereon is attached, like a label, onto an object. This method has the problem that the thermal transfer image-receiving sheet attached on the object, due to the thickness of the sheet, is easy to peel off from the object.

Japanese Patent Laid-Open No. 229292/1992 proposes a method which comprises the steps of peeling a dye-receptive layer, with a dye image formed thereon, from the substrate sheet of a thermal transfer image-receiving sheet, bringing the dye-receptive layer into contact with an object, heating the dye-receptive layer at a high temperature to transfer the dye image to the object, and peeling the dye-receptive layer from the object.

This process requires such a troublesome step that a dye-receptive layer is once peeled off from the substrate sheet of a thermal transfer image-receiving sheet and then pressed against an object. Further, the need for the peeling of a dye-receptive layer imposes a limitation on the selection of materials for both the substrate sheet and the dye-receptive layer. Furthermore, since the peeled dye-receptive layer alone is handled, it should have proper strength and thickness, again imposing a limitation on the selection of materials.

Accordingly, an object of the present invention is to provide a simple method for producing an image on an object which enables a thermal transfer image-receiving sheet, as such, to be used without peeling the dye-receptive layer from the substrate.

Another object of the present invention is to provide a thermal transfer sheet and a thermal transfer image-receiving sheet which, when used in the above method, can achieve good color reproduction without causing a color change and produce a high-density and sharp image on an object.

SUMMARY OF THE INVENTION

To achieve the foregoing objects and in accordance with the purpose of the invention, as embodied and broadly described herein, the method of this invention for forming an image on an object comprises the steps of thermally transferring a dye from a thermal transfer sheet to the dye-receptive layer of a thermal transfer image-receiving sheet thereby to form a dye image on the sheet; contacting the dye-receptive layer side of the thermal transfer image-receiving sheet with an object; thermally transferring the dye image on the thermal transfer image-receiving sheet to the object by heating of the sheet; and peeling the sheet from the object.

The thermal transfer sheet of the present invention comprises a support and, provided thereon, at least a yellow dye-holding layer, a magenta dye-holding layer and a cyan dye-holding layer, said dye-holding layers each comprising a thermal transfer dye and a binder resin, said yellow dye-holding layer comprising as the thermal transfer dye a dye represented by the following formula 1 and/or a dye represented by the following formula 2, said magenta dye-holding layer comprising as the thermal transfer dye a dye represented by the following formula 3 and at least one dye selected from those represented by the following formulae 4 and 5, said cyan dye-holding layer comprising as the thermal transfer dye a dye represented by the following formula 6:

Formula 1

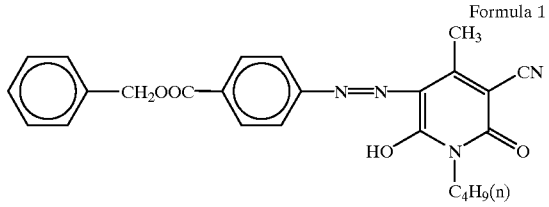

-continued

Formula 2

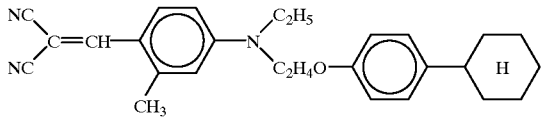

Formula 3

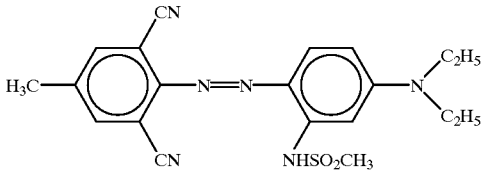

Formula 4

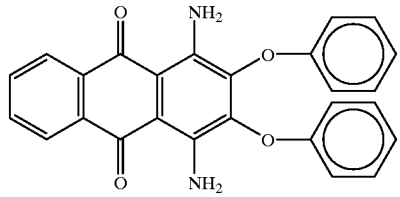

Formula 5

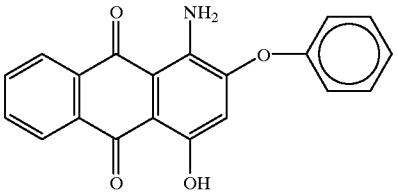

Formula 6

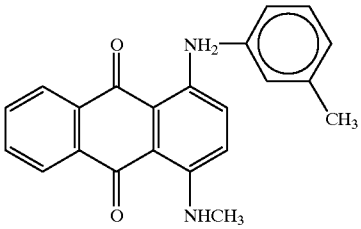

The thermal transfer image-receiving sheet of the present invention comprises a substrate sheet, a dye-receptive layer, and, provided between said substrate sheet and said dye-receptive layer, a dye release layer comprising a hydrophilic material.

With the method for forming an image on an object of the present invention, there is no need of peeling the dye-receptive layer of a thermal transfer image-receiving sheet from the substrate sheet, and what is needed is only to attach the thermal transfer image-receiving sheet, as it is, to an object and thus the formation of an image on the object can be achieved in a simplified manner.

When the thermal transfer sheet of the present invention is used in the above method, since the specific dyes used therein have excellent heat resistance, the dyes do not undergo any color change in the course of image formation during which the dyes are exposed to a high temperature, thus enabling the formation of an image on an object with excellent color reproduction. Further, since the image thus formed on an object has excellent heat resistance, the object can be advantageously used under high temperature conditions without entailing deterioration of the image.

When the thermal transfer image-receiving sheet of the present invention is used in the above method, since the dye release layer promotes transfer of a dye image formed on the sheet to an object, a high-density and sharp image can be formed on an object.

DETAILED DESCRIPTION OF THE INVENTION

Method for Forming Image on Objects

The method for forming an image on an object according to the present invention will now be described with reference to the accompanying drawings.

Figure 1:
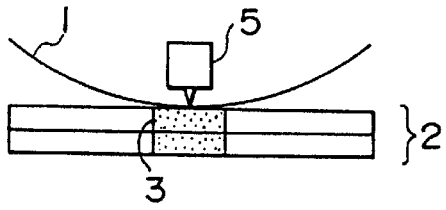
FIG. 1 is a diagram showing the step of thermally transferring a dye from a thermal transfer sheet to a thermal transfer image-receiving sheet in the method for producing an image according to the present invention.
Figure 2:
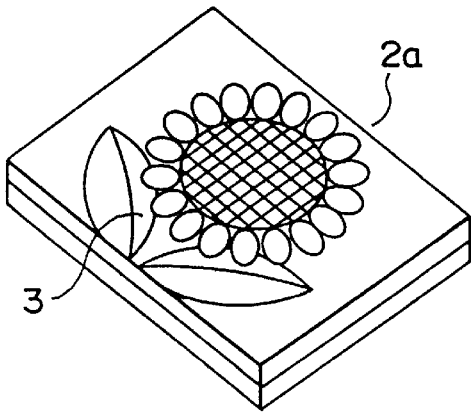
FIG. 2 is a diagram showing a thermal transfer image-receiving sheet with a dye image formed thereon by the step shown in FIG. 1.

At the outset, the formation of a dye image on a thermal transfer image-receiving sheet using a thermal transfer sheet may be carried out by any conventional method using a known thermal transfer printer such as a thermal printer or a video printer. FIG. 1 shows the step of transferring a dye from a thermal transfer sheet 1 to a thermal transfer image-receiving sheet 2 by means of a thermal transfer printer using a thermal head 5 to form a dye image 3 on the sheet 2. Thus, a thermal transfer image-receiving sheet 2*a* with a dye image 3 formed thereon, as shown in FIG. 2, is provided as an intermediate medium.

Figure 3:
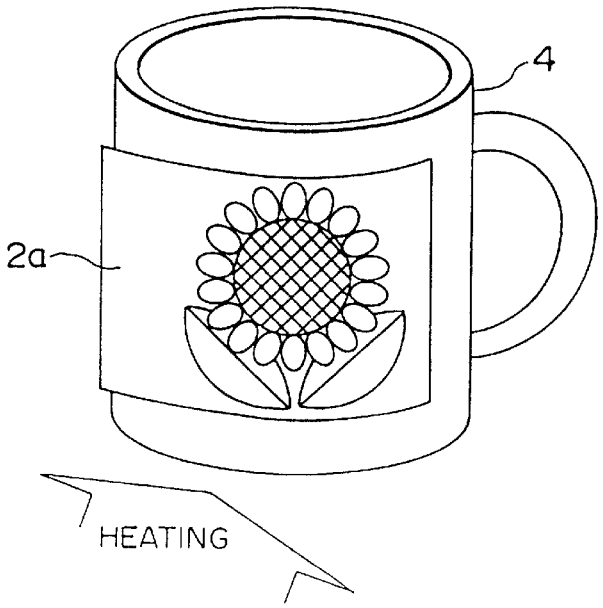
FIG. 3 is a diagram showing the step of thermally transferring the dye image on the sheet of FIG. 2 onto an object (a mug)

The dye image 3 is then thermally transferred from the thermal transfer image-receiving sheet 2*a* to an object. In FIG. 3, the thermal transfer image-receiving sheet 2*a* is being contacted with the outer surface of a mug 4, a ceramic drinking cup having a quadratic outer surface, and then heated to transfer the dye image to the object.

More specifically, the dye-receptive layer side of a thermal transfer image-receiving sheet with a dye image transferred thereto is brought into contact with an object. In the contact of a thermal transfer image-receiving sheet with an object, the presence of a gap therebetween results in lowered dye image density or cause the resultant dye image to blur. For this reason, a thermal transfer image-receiving sheet is press-contacted with an object.

In the press contact, what is needed is to bring a thermal transfer image-receiving sheet into contact with an object to such an extent that the sheet neither rises nor shifts in the course of dye transfer, and no large force is required for pressing a thermal transfer image-receiving sheet against the surface of an object. In order to keep a thermal transfer image-receiving sheet tightly contacted with an object, it is preferred to apply force through an elastomer less likely to adhere to the object, thereby press-contacting the sheet with the object. Heating may be carried out from the side of a thermal transfer image-receiving sheet, from the side of an object, or from both sides of thermal transfer image-receiving sheet and the object. In the case where the object is a cylindrical one like a mug, a dye image can be transferred from a thermal transfer image-receiving sheet to the object by, for example, applying the sheet to the outer surface of the object, covering the sheet with a rubber sheet, further covering the rubber sheet with a circular heater, and conducting heating with the thermal transfer image-receiving sheet being press-contacted with the object.

The heating temperature and heating time for the transfer of a dye image from a thermal transfer image-receiving sheet to an object are such that dye molecules are fully transferred to the object without causing fusion-bonding of the thermal transfer image-receiving sheet to the object and color change of the dye by heat. They vary depending upon the heat resistance, thermal capacity, and other properties of the object. For example, when the object is a mug as shown in FIGS. 3 and 4, heating is usually carried out at 100 to 250° C. for about 1 to 10 min. Upon the completion of heating for a required period of time, the object is air-cooled or water-cooled near to room temperature, and the thermal transfer image-receiving sheet is then peeled off from the object. Thus, a dye image is formed on the object.

Figure 4A:
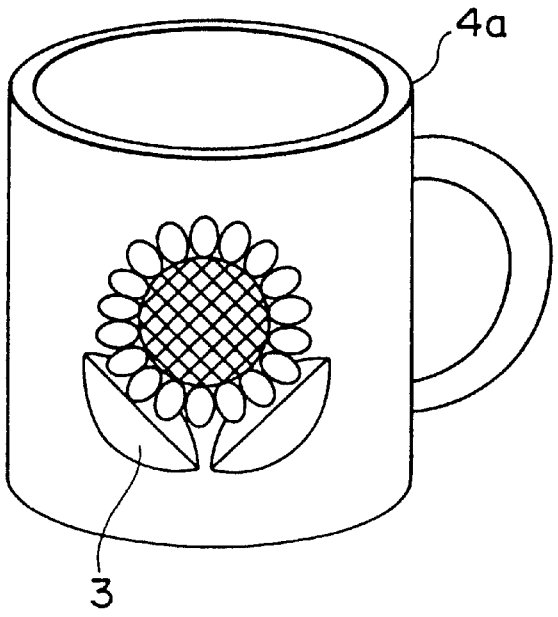
FIG. 4A and FIG. 4B are respectively a diagram showing a mag cup having a transferred dye image after peeling of the thermal transfer image-receiving sheet from the mug following the step of FIG. 3 and a diagram showing a spent thermal transfer image-receiving sheet.
Figure 4B:
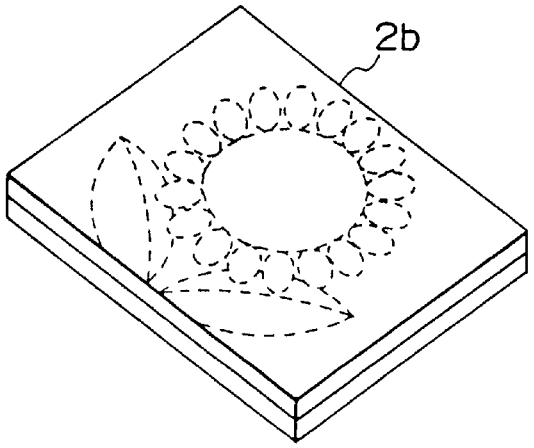

FIGS. 4A and 4B respectively show a mug 4*a* with a dye image 3 transferred thereto and a thermal transfer image-receiving sheet 2*b* from which a dye image has been transferred to the mug.

Thermal Transfer Sheet

Figure 5:
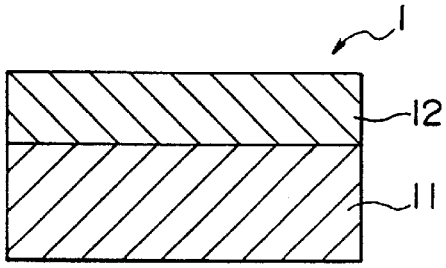
FIG. 5 is a longitudinal sectional view of an embodiment of the thermal transfer sheet according to the present invention.

FIG. 5 is a longitudinal sectional view of an embodiment of the thermal transfer sheet of the present invention.

A thermal transfer sheet 1 of the present invention comprises at least a support 11 and a dye-holding layer 12.

The support 11 may be formed of any material so far as the heat resistance and strength are high enough to withstand heat applied during thermal transfer, and examples thereof include films of polyester resins, such as polyethylene terephthalate, polyethylene naphthalate, and 1,4-polycyclohexylene dimethyl terephthalate, polycarbonate resins, cellophane, cellulosic resins, such as cellulose acetate, and other resins, such as polyethylene, polypropylene, polystyrene, polyphenylene sulfide, polyvinyl chloride, polyvinylidene chloride, nylon, polyimide, polyvinyl alcohol, fluororesins, chlorinated rubbers, and ionomers. Further examples thereof include various types of paper, such as capacitor paper and paraffin paper, nonwoven fabrics, or composites comprising these materials and the above resins.

Among them, polyethylene terephthalate film is most commonly used as the support.

The thickness of the support 11 may be properly selected according to the applications and materials so as to provide desired mechanical strength, thermal conductivity, and other properties and is generally about 1.5 to 50 $\mu$m, preferably 2 to 10 $\mu$m.

The dye-holding layer 12 comprises a binder resin and, held therein by dissolution or dispersion, thermal transfer dyes, which can be transferred to an image-receiving sheet by sublimation upon heating, as represented by the formulae 1 to 6 shown below.

The binder resin may be any conventional one. Properties required of the binder resin include that the affinity for dyes is proper, that the dye held in the binder resin exhibits good transferability to a thermal transfer image-receiving sheet by sublimation upon heating by heating means, such as a thermal head, and that, when the dye-holding layer is in an exposed state, the binder resin per se is neither fused nor transferred to an object upon heating.

Examples of such a binder resin include cellulosic resins, such as ethyl cellulose, hydroxyethyl cellulose, ethylhydroxyethyl cellulose, hydroxypropyl cellulose, methyl cellulose, nitrocellulose, cellulose acetate, and cellulose acetate butyrate, polyvinyl acetal resins, such as polyvinyl alcohol, polyvinyl acetate, polyvinyl butyral, and polyvinyl acetoacetal, vinyl resins, such as polyacrylamide and polyvinylpyrrolidone, and other resins, such as polyesters and polyamides. These resins may be used alone or as a mixture of two or more.

Among these resins, a binder resin composed mainly of a polyvinyl acetal resin, such as polyvinyl butyral or polyvinyl acetoacetal, is particularly preferred from the viewpoint of heat resistance and dye transfer.

Dyes represented by the following formulae 1 to 6 are used as dyes to be incorporated in the dye-holding layer 12.

Formula 1

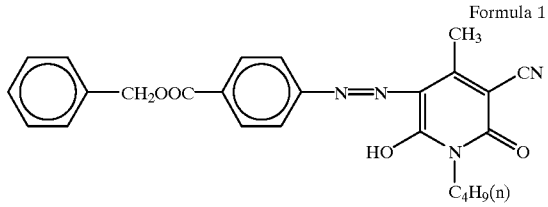

Formula 2

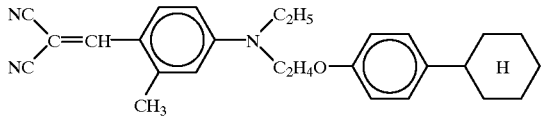

Formula 3

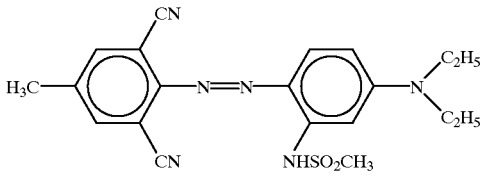

Formula 4

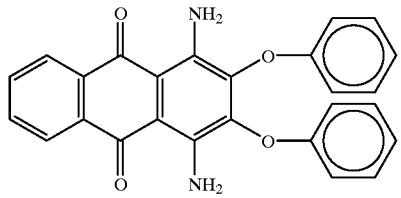

-continued

Formula 5

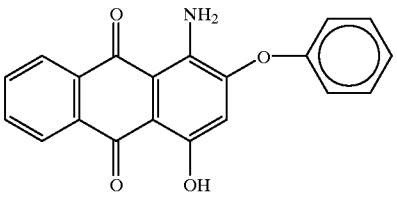

Formula 6

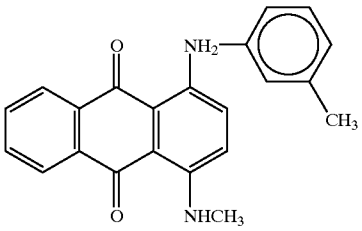

The dyes represented by the formulae 1 and 2 exhibit a hue of yellow, the dyes represented by the formulae 3, 4 and 5 exhibit a hue of magenta, and the dye represented by the formula 6 exhibits a hue of cyan. In the present invention, the dye represented by the formula 1 and/or the dye represented by the formula 2 are used for a yellow dye-holding layer, at least one dye represented by the formulae 3, 4, and 5 is used for a magenta dye-holding layer, and the dye represented by the formula 6 is used for a cyan dye-holding layer.

In general, for a thermal transfer sheet for a full-color image, dyes of three colors of yellow, magenta, and cyan and, if necessary, dyes of four colors in total of the above three colors in combination with a dye of black are used. In a thermal transfer sheet, it is a common practice to successively form dye-holding layers 12 having a plurality of color components on the same plane of a continuous support 11, and the order of the dye-holding layers successively arranged on the same plane may be any desired one.

When a black dye-holding layer is formed on the thermal transfer sheet of the present invention, it is possible to combine dyes of yellow, magenta, and cyan represented by the formulae 1 to 6 with one another.

The reason why, in the thermal transfer sheet of the present invention, a dye represented by the formula 4 and/or a dye represented by the formula 5 are incorporated in a magenta dye-holding layer 12 is that both the dyes have high heat resistance and, hence, are less likely to undergo a color change and exhibit very excellent color reproduction in such applications that the thermal transfer sheet of the present invention is used, i.e., applications where the material is required to have heat resistance because it is subjected to heat history.

However, when the dye represented by the formula 4 and/or the dye represented by the formula 5 alone are used, the formation of a dye image on a thermal transfer image-receiving sheet followed by the transfer of the dye onto an object, such as a mug, causes the image density to be lowered and the balance of colors to be deteriorated and different from that of an original or that of the dye image formed on the thermal transfer image-receiving sheet.

In the thermal transfer sheet of the present invention, in order to solve this problem, a dye represented by the formula 3, in addition to the dye represented by the formula 4 and/or the dye represented by the formula 5, is incorporated in the magenta dye-holding layer. Although the dye represented by the formula 3 is inferior in heat resistance to the dyes represented by the formulae 4 and 5, it has the effect of providing a dye image having a high density independently of whether the transfer is carried out once or twice.

Further, in order to regulate the hue, dyes commonly used in the conventional thermal dye transfer system may be added to the dye-holding layer in such an amount as will not be detrimental to the heat resistance. It is, of course, possible to provide a thermal transfer sheet having excellent heat resistance by properly mixing the specific dyes represented by the formulae 1 to 6 together, for example, by adding the yellow dye represented by the formula 1 and/or the yellow dye represented by the formula 2 or the cyan dye represented by the formula 6 to the magenta dyes represented by the formulae 3 to 5.

Furthermore, in order to regulate the hue, other known yellow dyes, magenta dyes, and cyan dyes may be incorporated, and representative examples of these dyes include diarylmethane dyes; triarylmethane dyes; thiazole dyes; methine dyes, such as merocyanine; azomethine dyes, exemplified by indoaniline, acetophenone, azomethine, pyrazolone azomethine, imidazole azomethine, imidazoazomethine, and pyridone azomethine; xanthene dyes; oxazine dyes; cyanomethylene dyes exemplified by dicyanostyrene and tricyanostyrene; thiazine dyes; azine dyes; acridine dyes; benzene azo dyes; heterocyclic azo dyes exemplified by pyridone azo, thiophene azo, isothiazole azo, pyrrole azo, pyrazole azo, imidazole azo, thiadiazole azo, triazole azo, and disazo dyes; spiropyran dyes; indolinospiropyran dyes; fluoran dyes; rhodamine lactam dyes; naphthoquinone dyes; anthraquinone dyes; and quinophthalone dyes. Specific preferred dyes are as follows:

C.I. (color index) Disperse Yellow 51, 3, 54, 79, 60, 23, 7, 141, 201, and 231;

C.I. Disperse Blue 24, 56, 14, 301, 334, 165, 19, 72, 87, 287, 154, 26, and 354;

C.I. Disperse Red 135, 146, 59, 1, 73, 60, and 167;

C.I. Disperse Violet 4, 13, 26, 36, 56, and 31;

C.I. Disperse Orange 149;

C.I. Solvent Yellow 56, 14, 16, and 29;

C.I. Solvent Blue 70, 35, 63, 36, 50, 49, 111, 105, 97, and 11;

C.I. Solvent Red 135, 81, 18, 25, 19, 23, 24, 143, 146, and 182;

C.I. Solvent Violet 13;

C.I. Solvent Black 3; and

C.I. Solvent Green 3.

More specific examples of cyan dyes include Kayaset Blue 714 (Solvent Blue 63, manufactured by Nippon Kayaku Co., Ltd.), Foron Brilliant Blue S-R (Disperse Blue 354, manufactured by Sandoz K. K.), and Waxoline AP-FW (Solvent Blue 36, manufactured by ICI Japan), more specific examples of magenta dyes include MS-REDG (Disperse Red 60, manufactured by Mitsui Toatsu Chemicals, Inc.) and Macrolex Red Violet R (Disperse Violet 26, manufactured by Bayer), and more specific examples of yellow dyes include Foron Brilliant Yellow S-6GL (Disperse Yellow 231, manufactured by Sandoz K. K.) and Macrolex Yellow 6G (Disperse Yellow 201, manufactured by Bayer). Furthermore, dyes having the following skeletons may also be used.

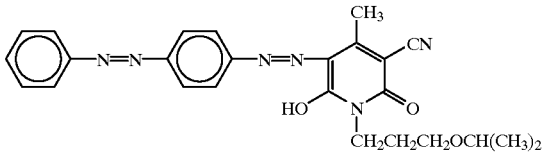

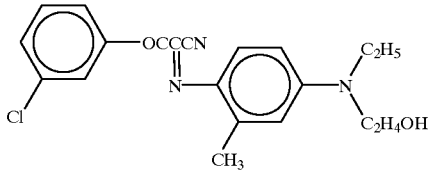

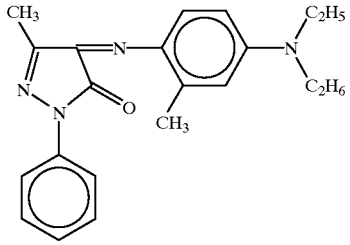

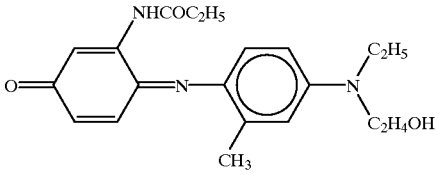

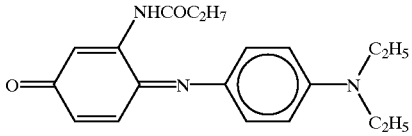

Furthermore, the following dyes can also be suitably used: sublimable yellow dyes described in Japanese Patent Laid-Open Nos. 78895/1984, 28451/1985, 28453/1985, 53564/1985, 148096/1986, 289290/1985, 31565/1985, 30393/1985, 53565/1985, 27594/1985, 262191/1986, 152563/1985, 244595/1986, and 196186/1987 and International Publication WO92/05032, sublimable magenta dyes described in Japanese Patent Laid-Open Nos. 223862/1985, 28452/1985, 31563/1985, 78896/1984, 31564/1985, 30391/1985, 227092/1986, 227091/1986, 30392/1985, 30394/1985, 131293/1985, 227093/1986, 159091/1985, and 262190/1986, U.S. Pat. No. 4,698,651, Japanese Patent Application No. 220793/1987, and U.S. Pat. No. 5,079,365, and sublimable cyan dyes described in Japanese Patent Laid-Open Nos. 78894/1984, 227490/1984, 151098/1985, 227493/1984, 244594/1986, 227948/1984, 131292/1985, 172591/1985, 151097/1985, 131294/1985, 217266/1985, 31559/1985, 53563/1985, 255897/1986, 239289/1985, 22993/1986, 19396/1986, 268493/1986, 35994/1986, 31467/1986, 148269/1986, 49893/1986, 57651/1986, 239291/1985, 239292/1985, 284489/1986, and 191191/1987, Japanese Patent Application No. 176625/1987, and U.S. Pat. No. 5,079,365. Among them, dyes represented by the following general formulae are preferred.

General formula 1

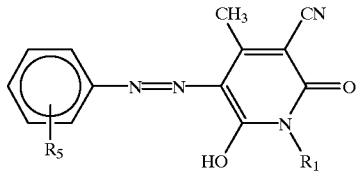

General formula 2

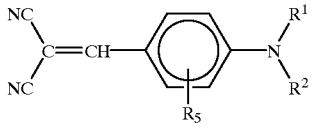

General formula 3

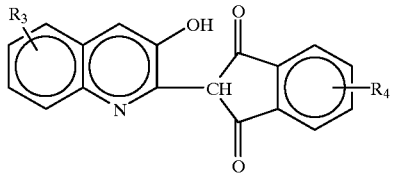

General formula 4

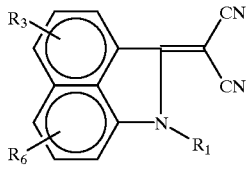

General formula 5

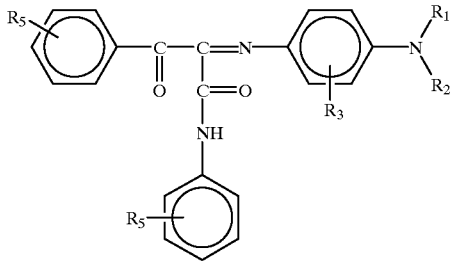

General formula 6

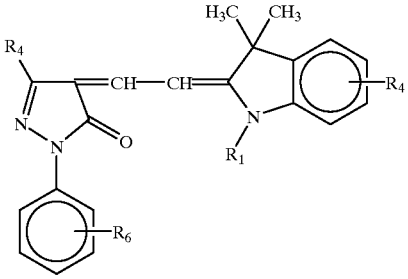

General formula 7

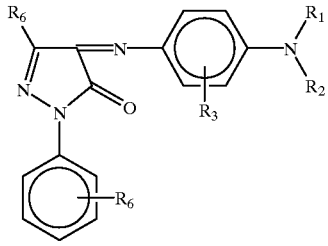

-continued

General formula 8

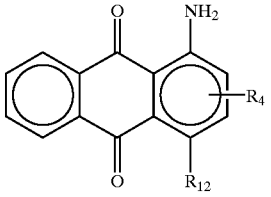

General formula 9

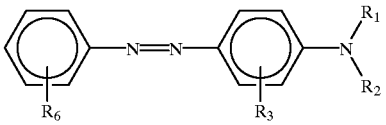

General formula 10

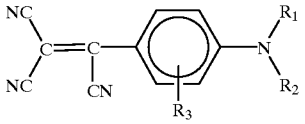

General formula 11

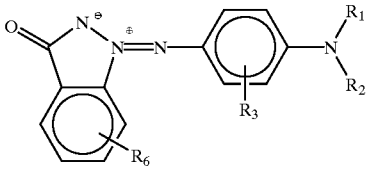

General formula 12

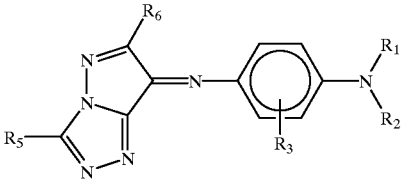

General formula 13

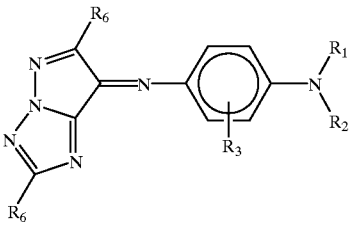

General formula 14

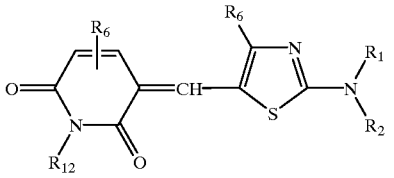

General formula 15

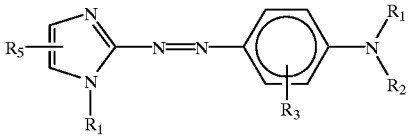

-continued

General formula 16

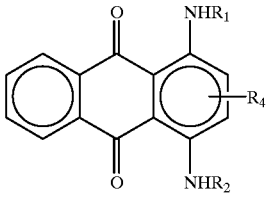

General formula 17

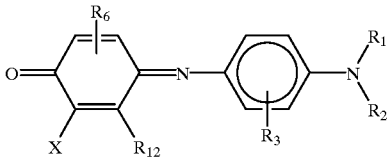

General formula 18

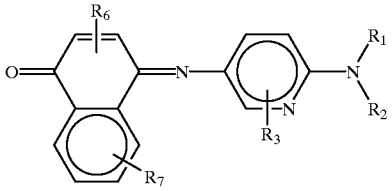

General formula 19

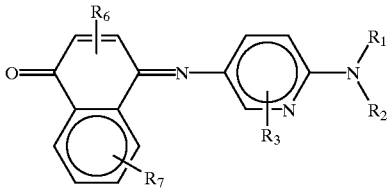

General formula 20

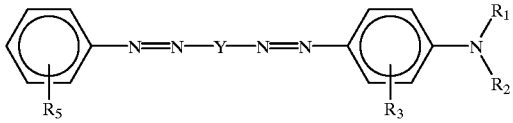

General formula 21

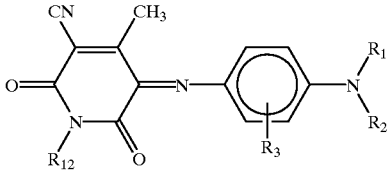

In the above general formulae, R, X, and Y represent the following substituents.

$R_1$ and $R_2$

A substituted or unsubstituted alkyl group, a substituted or unsubstituted cycloalkyl group, or a substituted or unsubstituted aralkyl group.

$R_3$

A substituted or unsubstituted alkyl group, a substituted or unsubstituted alkoxy group, a substituted or unsubstituted alkylcarbonylamino group, a substituted or unsubstituted alkylsulfonylamino group, a substituted or unsubstituted alkylaminocarbonyl group, a substituted or unsubstituted alkylaminosulfonyl group, or a halogen atom.

$R_4$

A substituted or unsubstituted alkoxycarbonyl group, a substituted or unsubstituted alkylaminocarbonyl group, a substituted or unsubstituted alkoxy group, a substituted or unsubstituted alkyl group, a substituted or unsubstituted cycloalkyl group, a heterocyclic group, or a halogen atom.

$R_5$

A substituted or unsubstituted alkyl group, a substituted or unsubstituted alkoxycarbonyl group, a substituted or unsubstituted alkylaminocarbonyl group, a substituted or unsubstituted alkoxy group, a substituted or unsubstituted alkylaminosulfonyl group, a substituted or unsubstituted cycloalkyl group, a cyano group, a nitro group, a halogen atom, or a hydrogen atom.

$R_6$

A substituted or unsubstituted alkyl group, a substituted or unsubstituted aryl group, a substituted or unsubstituted amino group, a substituted or unsubstituted cycloalkyl group, a cyano group, a nitro group, or a halogen atom.

$R_7$

A substituted or unsubstituted alkyl group, a substituted or unsubstituted amino group, a substituted or unsubstituted alkoxy group, a substituted or unsubstituted alkoxycarbonyl group, or a halogen atom.

$R_8$

A substituted or unsubstituted aryl group, an aromatic heterocyclic group, a cyano group, a nitro group, a halogen atom, or other electron-withdrawing groups.

$R_9$ $CONHR_{10}$, $SO_2NHR_{10}$, $NHCOR_{11}$, $NHSO_2R_{11}$, or a halogen atom.

$R_{10}$

A substituted or unsubstituted alkyl group, a substituted or unsubstituted cycloalkyl group, a substituted or unsubstituted aryl group, or a substituted or unsubstituted aromatic heterocyclic group.

$R_{11}$

A substituted or unsubstituted alkyl group, a substituted or unsubstituted cycloalkyl group, a substituted or unsubstituted amino group, a substituted or unsubstituted aryl group, or a substituted or unsubstituted aromatic heterocyclic group.

$R_{12}$

A substituted or unsubstituted alkyl group.

$R_{13}$

An amino group or a hydroxyl group.

X

A halogen atom.

Y

A substituted or unsubstituted aryl group or a substituted or unsubstituted aromatic heterocyclic group.

The proportion of the dye incorporated in the dye-holding layer 12 may be regulated as desired depending upon the sublimation (or melting) temperature, the transferability of dye, and the like. It is generally 5 to 75% by weight, preferably 10 to 60% by weight, based on the total weight of the dye-holding layer. When the proportion of the dye incorporated in the dye-holding layer is less than 5% by weight, the density of a print formed on the thermal transfer image-receiving sheet or the sensitivity to heat are lowered. On the other hand, when it exceeds 75% by weight, the storage stability of the thermal transfer sheet and the adhesion between the dye-holding layer and the support are deteriorated.

The dye-holding layer 12 may be provided on the support 11 by any conventional method, for example, a method which comprises adding a dye(s), a binder resin, and other desired additive components to a suitable solvent to dissolve or disperse the components in the solvent, thereby preparing a coating solution or an ink for the formation of a dye-holding layer, applying the coating solution or ink onto a support by the conventional coating method or printing method, and drying the resultant coating to remove the solvent.

The thickness of the dye-holding layer 12 thus formed is 0.2 to 5.0 μm, preferably about 0.4 to 2.0 μm.

Figure 6:
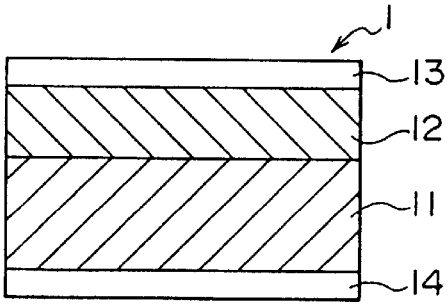
FIG. 6 is a longitudinal sectional view of another embodiment of the thermal transfer sheet according to the present invention.

Thus, the thermal transfer sheet of the present invention is obtained. As shown in FIG. 6, an anti-tack layer 13 may be additionally provided on the surface of the dye-holding layer 12, and a lubricious layer 14 may be additionally provided on the back side of the thermal transfer sheet 1. Further, conventional treatments for improving the adhesion of the surface of the support, such as corona discharge treatment or the provision of an anchor layer, may be carried out for the support 11 from the viewpoint of improving the adhesion between the dye-holding layer 12 and the support 11 and between the lubricious layer 14 and the support 11. The provision of the above additional layer, corona discharge treatment, and other treatments for improving the adhesion of the support may be used alone or in combination of two or more.

The anti-tack layer 13 serves to prevent the thermal transfer sheet from fusing to a thermal transfer image-receiving sheet in the course of thermal transfer, and mere deposition of an inorganic powder having an anti-tack property offers considerable effect. Further, for example, a layer of a releasable resin having excellent releasability, such as a silicone resin, an acrylic resin, or a fluororesin, may be provided in a thickness of 0.01 to 5 μm, preferably about 0.05 to 2 μm.

Alternatively, a method may be used wherein the above releasable resin having an anti-tack property, fine particles thereof, or inorganic fine particles are mixed with a binder resin and the mixture is incorporated into the dye-holding layer.

Furthermore, it is also possible to use a releasable binder resin prepared by graft-polymerizing a releasable segment, such as a polysiloxane segment, a long chain alkyl group segment, or a hydrocarbon fluoride segment, onto the above binder resin.

The lubricious layer 14 serves to prevent the thermal transfer sheet from fusing to a thermal head which comes into contact with the back side of the thermal transfer sheet during thermal transfer operation and, at the same time, renders the thermal transfer sheet more smoothly slidable. A heat resisting material, for example, a reaction product of a urethane resin, a melamine resin, an epoxy resin, a silicone resin, or an isocyanate with a resin containing active hydrogen, such as polyvinyl butyral or polyvinyl acetoacetal, is generally used for this purpose. If necessary, known additives, such as antistatic agents, lubricants, and fillers, may further be incorporated into the layer, and the thickness of the lubricious layer 14 may be 0.5 to 5 μm, preferably about 1 to 2 μm.

The thermal transfer sheet of the present invention may be in the form of a leaf cut into a desired size, a continuous or coiled form, and a ribbon form having a narrow width.

<Thermal Transfer Image-receiving Sheet>

Figure 7:
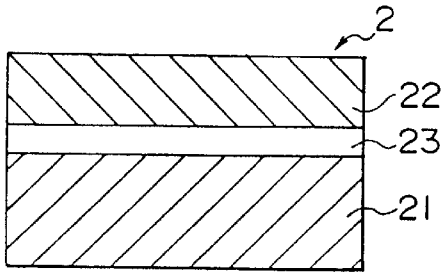
FIG. 7 is a longitudinal sectional view of an embodiment of the thermal transfer image-receiving sheet according to the present invention.

The thermal transfer image-receiving sheet of the present invention will now be described in detail. FIG. 7 is a longitudinal sectional view showing an embodiment of a thermal transfer image-receiving sheet usable in the method for forming an image according to the present invention. In the drawing, a thermal transfer image-receiving sheet 2 comprises a substrate sheet 21, a dye-receptive layer 22, and a dye release layer 23 interposed between the substrate sheet 21 and the dye-receptive layer 22.

Figure 8:
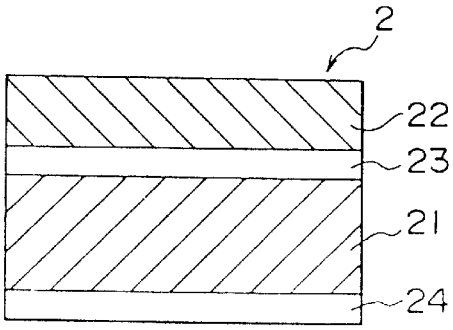
FIG. 8 is a longitudinal sectional view of another embodiment of the thermal transfer image-receiving sheet according to the present invention.

Further, in the thermal transfer image-receiving sheet of the present invention, a back surface layer 24 may be provided on the back surface of the substrate sheet 21, as shown in FIG. 8. When a dye image is transferred from the thermal transfer image-receiving sheet to an object by applying force to the sheet from the back surface thereof by means of an elastic material such as rubber, the back surface layer serves to prevent the sheet from adhering to the elastic material.

Examples of the substrate sheet 21 used in the thermal transfer image-receiving sheet 2 include synthetic paper, such as polyolefin and polystyrene synthetic paper; coated paper, such as art paper, coat paper, and cast coated paper; thin paper such as glassine paper, capacitor paper, and paraffin paper; other types of paper, such as wood-free paper; films of polyester resins, such as polyethylene terephthalate, polyethylene naphthalate, and 1,4-polycyclohexylene dimethyl terephthalate, polycarbonate resins, cellophane, cellulosic resins, such as cellulose acetate, and other resins, such as polyethylene, polypropylene, polystyrene, polyphenylene sulfide, polyvinyl chloride, polyvinylidene chloride, nylon, polyimide, polyvinyl alcohol, fluororesins, chlorinated rubbers, and ionomers; nonwoven fabrics; and composites formed by combining the above synthetic papers, papers, and resin films, for example, a laminate of paper combined with a resin film and a composite of a resin coated on paper. Furthermore, it is also possible to use a composite formed by adding a white pigment or a filler to a resin, forming the mixture into an opaque or foamed sheet, and providing the above layer on the sheet by melt extruding or the like.

The substrate sheet may be transparent or opaque. The thickness of the substrate sheet is usually 30 to 300 $\mu$m, preferably 150 to 200 $\mu$m.

The dye-receptive layer 22 serves to receive a dye being thermally transferred from the thermal transfer sheet 1, thereby forming a dye image. Thereafter, it again transfers, i.e., releases, the dye image to a final object by taking advantage of heat. That is, the dye-receptive layer 22 serves as an intermediate medium.

Thus, the dye-receptive layer 22 is required to have a combination of the receptivity to a thermal transfer dye and the releasability of the dye, which properties are seemingly contradictory to each other. However, the purpose of the dye-receptive layer can be basically attained to considerable extent by properly selecting temperature conditions for receiving the dye, temperature conditions for releasing the dye, dye used, and materials such as resins for constituting the dye-holding layer and the dye-receptive layer of the thermal transfer sheet even when the conventional resins commonly used for constituting a dye-receptive layer 22 are used. However, the use of a resin which is less likely to fuse to the surface of an object during the transfer of the object is preferred.

The above dye-receptive layer 22 may comprise a conventional thermoplastic resin, and examples of the thermoplastic resin include polyolefin resins, such as polypropylene; halogen-containing resins, such as polyvinyl chloride and polyvinylidene chloride; vinyl acetate resins, such as polyvinyl acetate, ethylene/vinyl acetate copolymer, and vinyl chloride/vinyl acetate copolymer; polyvinyl acetal resin; acrylic resins, such as poly(meth)acrylic ester; polystyrene resins, such as polystyrene; copolymer of olefin, such as ethylene or propylene with other vinyl monomers; polyester resins, such as polyethylene terephthalate and polybutylene terephthalate; polycarbonate resin; cellulosic resins, such as cellulose acetate; polyamides; and ionomers. They may be used alone or in the form of a mixture of two or more.

Further, a thermosetting resin prepared by incorporating the organic silicon compound into the above thermoplastic resin or adding a crosslinking agent to the above thermoplastic resin is preferred because it is less likely to fuse to an object.

For the organic silicon compound used, reactive organic silicon compounds, such as silicone oil, having a functional group, such as an amino group, a hydroxyl group, a mercapto group, an epoxy group, an isocyanate group, a carboxyl group, or a vinyl group, are used as a precursor to the organic silicon compound.

The reactive organic silicon compound as the precursor is reacted with a reactive thermoplastic resin having a functional group reactive with the precursor to prepare a graft polymer which is used as the organic silicon compound. The reactive thermoplastic resin used herein may be any member selected from the above thermoplastic resins so far as it has a reactive functional group.

Alternatively, the organic silicon compound may be a graft polymer prepared by providing as a crosslinking agent a polyfunctional reactive compound, such as polyisocyanate and polyamine, and reacting the above reactive organic silicon compound, having a functional group reactive with the crosslinking agent, with the above reactive thermoplastic resin.

Further, the organic silicon compound may be a graft polymer prepared by copolymerizing a reactive organic silicon compound having a vinyl group, such as silicone oil, with a general monomer having a vinyl group, an acryloyl group, or the like.

The addition of the organic silicon compound thus prepared to the resin for constituting a dye-receptive layer causes a branch polymer portion composed of the grafted reactive organic silicon compound to be distributed on the surface of the dye-receptive layer, while a backbone polymer portion composed of the reactive thermoplastic resin is in such a state as mixed and united with the resin constituting the dye-receptive layer. This imparts, to the surface of the dye-receptive layer, excellent oil repellency and slidability enough to be slidable at the time of printing. Further, it has the effect of preventing the dye-receptive layer from fusing to an object at the time of dye transfer to the object.

The amount of the above organic silicon compound added is preferably 1 to 50 parts by weight based on 100 parts by weight of the resin for constituting the dye-receptive layer. When it is excessively small, the oil repellency and the lubricity become unsatisfactory, making it impossible to provide desired resistance to fingerprint, plasticizer, and scratching. On the other hand, when it is excessively large, the transfer of the dye from the thermal transfer sheet becomes unsatisfactory, making it impossible to provide a transferred image having a high density. This further deteriorates the strength of the dye-receptive layer.

Crosslinking agents to be used for crosslinking the thermoplastic resin include polyisocyanate compounds, polyepoxide compounds having an epoxy group, polyamine compounds, chelate compounds represented by the following formula, alcoholates, and ester gums. Among them, chelate compounds are particularly preferred.

$$(R_1\text{—}O)_m\text{—}M(X)_n$$

wherein

M: metal atom (titanium, aluminum, or zirconium);

$R_1$: alkyl group, aryl group, or hydrogen or the like;

m+n=3 or 4;

X: glycol, β-diketone, hydroxycarboxylic acid, keto ester, or keto alcohol.

Examples of the form of coordination to metal atom M include those represented by the following formulae (1) to (5). In the formulae, $R_2$ to $R_9$ each independently represents an alkyl group, an aryl group, or hydrogen or the like.

(1)

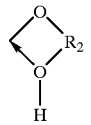

(2)

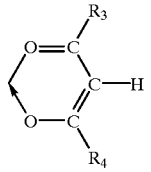

(3)

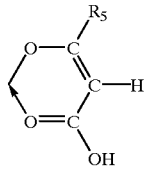

(4)

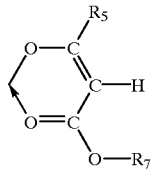

(5)

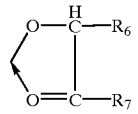

The amount the crosslinking agent used may vary according to the kind and functionality of the reactive thermoplastic resin reactive with the crosslinking agent, the molecular weight and functionality of the crosslinking agent, and other factors. It, however, is preferably about 0.5 to 20 parts by weight based on 100 parts by weight of the thermoplastic resin.

The use of the crosslinking agent has the effect of preventing the thermal transfer image-receiving sheet from fusing to an object.

The dye-receptive layer 22 may be provided on the substrate sheet 21 by any conventional method. Specifically, the provision of the dye-receptive layer 22 may be carried out by a method which comprises dissolving or dispersing the above thermoplastic resin and optionally the organic silicon compound, crosslinking agent and other desired additives in a suitable solvent to prepare a coating solution or an ink for a dye-receptive layer, coating the coating solution on a substrate sheet by any conventional coating or printing method and drying the resulting coating to remove the solvent and, when a crosslinking agent is used, then heat-curing the coating.

The thickness of the dye-receptive layer 22 thus formed is 1 to 10 $\mu$m, preferably about 2 to 5 $\mu$m.

The thermal transfer image-receiving sheet according to the present invention, as shown in FIGS. 7 and 8, comprises a substrate sheet 21, a thermal transfer image-receiving layer 22, and a dye release layer 23 provided between the substrate sheet 21 and the thermal transfer image-receiving layer 22. The dye release layer 23 serves to accelerate the transfer of the dye image, which has been once transferred on the thermal transfer image-receiving sheet, to an object.

The dye release layer 23 is a layer, comprising a hydrophilic material, in which a dye is less likely to be dispersed. Specific examples of the hydrophilic material include extracts from algae, such as agar and sodium alginate; viscous substances derived from plants, such as gum arabic and Hibiscus manihot L.; animal proteins, such as casein and gelatin; viscous substances derived from fermentation, such as pullulan and dextran; starch and starch-like substances; cellulosic substances, such as methyl cellulose, carboxymethyl cellulose, and hydroxyethyl cellulose; synthetic polymers, such as polyvinyl pyrrolidone, polyvinyl ether, polymaleic acid copolymers, polar group-containing acrylic copolymers and polyvinyl alcohol; and inorganic polymers, such as sodium polyphosphate.

Among them, polyvinyl pyrrolidone resin and alkyl vinyl ether/maleic anhydride copolymer resin are particularly preferred. These resins are characterized by a high dye releasing capability, an excellent adhesion to various substrate sheets and dye-receptive layers, high strength in the form of a coating, and excellent heat resistance. Therefore, when an image is formed on a thermal transfer image-receiving sheet or when the image is transferred to an object, they can prevent delamination of the dye-receptive layer from the substrate sheet and heat fusing between the object and the thermal transfer image-receiving sheet.

The polyvinyl pyrrolidone resin and alkyl vinyl ether/maleic anhydride copolymer resin are soluble in water and, at the same time, highly soluble also in organic solvents including alcohol solvents, such as ethyl alcohol and isopropyl alcohol, and ketone solvents, such as methyl ethyl ketone and methyl isobutyl ketone, which organic solvents have a relatively low boiling point and, hence, can be easily removed upon drying of the resultant coating. They are highly miscible with various resins which are soluble in organic solvents. By virtue of the above properties, the above resins have excellent adhesion to various organic and inorganic materials.

Various additives may be, if necessary, incorporated into the resin for constituting the dye release layer and the resin for constituting the dye-receptive layer for the purpose of improving the whiteness, improving the strength and hardness, and imparting light fastness and other purposes.

An improvement in whiteness makes it possible to determine whether or not a dye image formed on a thermal transfer image-receiving sheet, i.e., an intermediate image, have a high quality enough to be transferred to a final object.

Examples of the additive include fillers, for example, inorganic fillers, such as silica, alumina, clay, talc, calcium carbonate, barium sulfate, white pigments, such as titanium oxide and zinc oxide, particles or fine particles of resins, such as acrylic resin, epoxy resin, polyurethane resin, phenolic resin, melamine resin, benzoguanamine resin, fluororesin, and silicone resin, fluorescent brightening agents, ultraviolet light absorbers, and antioxidant.

The amount of the additive used is in the range of from 10 to 30 parts by weight based on 100 parts by weight of the resin for constituting a dye release layer, and, for fluorescent brightening agents, the use thereof in a small amount suffices for contemplated purposes.

Besides the above resins for constituting the dye release layer, other resins may be optionally used in combination with the above resins for the purpose of improving the adhesion between the substrate sheet and the dye-receptive layer in such an amount as will not be detrimental to the effect of the dye release layer.

The dye release layer 23 may be provided on the substrate sheet 21 by any conventional coating method. For example, the provision of the release layer 23 may be carried out by a method which comprises providing the above resin and optional additives, dissolving or dispersing them in a suitable solvent, such as methanol, isopropyl alcohol, water, acetone, methyl ethyl ketone, ethyl acetate, toluene, xylene, or cyclohexanone to prepare a coating solution or an ink for a dye release layer, applying the coating solution or ink onto a substrate sheet by any conventional coating or printing method, for example, gravure coating, reverse-roll coating, gravure reverse-roll coating, gravure printing, or screen printing, and drying the resultant coating to remove the solvent.

The thickness of the dye release layer 23 thus formed is 0.05 to 5 $\mu$m, preferably about 0.1 to 3 $\mu$m. When the thickness is excessively small, problems are likely to occur including a deterioration in density of a dye image transferred onto an object and a deterioration in adhesion of the dye release layer to the substrate sheet, resulting in delamination of the dye-receptive layer. On the other hand, the formation of the dye release layer in an excessively high thickness is cost-ineffective.

When the thermal transfer image-receiving sheet of the present invention is used in the method for producing an image according to the present invention, the interposition of a dye release layer between the substrate sheet and the dye-receptive layer of the thermal transfer image-receiving sheet accelerates the transfer of a once transferred dye image on the dye-receptive layer to a final object. Although the mechanism for this effect has not been fully elucidated, the reason why the above effect can be attained is believed to be as follows.

The dye release layer is formed of a hydrophilic material, and the dye used is insoluble in water. Therefore, the dye and the dye release layer have poor affinity for each other, which is the first reason why the above effect can be attained because the dye release layer serves as a barrier layer for the back side of the sheet and, during transfer of the dye image to an object, prevents dye molecules from diffusing and migrating toward the back side of the sheet, accelerating the diffusion and transfer of the dye molecules toward the object.

The second reason is that the hygroscopicity of the dye release layer is higher than the other layers. Due to the hygroscopic nature of the dye release layer, water which is absorbed in the dye release layer causes diffusion or migration into the dye-receptive layer in the step of dye transfer to an object. In this case, the poor affinity of the water-insoluble dye for water creates repulsion, and, at the same time, water acts, like a plasticizer, on the resin constituting the dye-receptive layer, increasing the rate of diffusion of dye molecules present in the dye-receptive layer.

The above function of the dye release layer contributes to an improvement in density of a dye image produced on the object.

Further, the acceleration of the dye transfer results in reduced quantity of heat and time necessary for the dye transfer to an object. This reduces the amount of dye molecules diffused in the lateral direction relative to that diffused in the perpendicular direction for both the dye-receptive layer and the object in its layer on which a dye image is to be formed, rendering the dye image less likely to blur.

Furthermore, reduced quantity of heat and time 15 necessary for dye transfer to an object make it difficult for the dye-receptive layer of the thermal transfer dye-receiving sheet to fuse to the object.

When a back surface layer 24 is provided on the thermal transfer image-receiving sheet, polyvinyl acetal resins, such as acrylic resin, polyvinyl acetoacetal, and polyvinyl butyral, cellulosic resins, polyimide resins, and polyaramid resins may be used for this purpose. However, in order to prevent the thermal transfer image-receiving sheet from being deteriorated by heat upon the transfer of the dye image from the thermal transfer image-receiving sheet to an object, the glass transition temperature of the resin constituting the back surface layer is preferably 160° C. or above, particularly preferably 180° C. or above. In this respect, the use of cellulosic resins, such as cellulose acetate, polyimide resins, and the like is preferred. Further, inorganic fillers, such as silica and talc, and fine particles of resins including fluororesins, such as Teflon, silicone and polyamide resin, waxes, such as polyethylene wax and carnauba wax, lubricants, such as modified silicone oil, and the like may be incorporated into the back surface layer. In the method for producing an image according to the present invention, wherein a thermal transfer image-receiving sheet once receives a dye image transferred from a thermal transfer sheet and again transfers the received dye image to a final object, the thermal transfer image-receiving sheet of the present invention can be advantageously used as an intermediate medium. However, it can also be used as a final object, which is common in the thermal dye transfer system.

Object

The object used in the method for producing an image according to the present invention will now be described.

Unlike the formation of a dye image on a thermal transfer image-receiving sheet by means of a printer, the object used in the method according to the present invention is not restricted by printer mechanisms. Factors which impose restriction on the object include the thickness, size, heat capacity, and external shape of the object. Therefore, all objects in any form may be used in the method of the present invention.

Specific examples of the object include a cup like a mug for beverages, as shown in FIG. 4, made of earthenware, porcelain, enamel, metals, or plastics.

That a dye image can be formed even on an object having a curved surface is an advantage of a transfer method using a thermal transfer image-receiving sheet as an intermediate medium.

As described above, the material for the object is not particularly limited, and examples thereof include earthenware, porcelain, ceramics such as glass, metals, enamel, and plastics.

Regarding the shape, a cup is one example. Further, the object may be in the form of a glass plate or sheet, a plastic plate or sheet, a tile, or a metal plate or sheet, and, further, may be cylindrical, polygonally columnar, or curved.

Furthermore, it may be in a thin sheet form like a thermal transfer image-receiving sheet.

As described above, the shape and material of the object are not limited. However, in order that the receptivity to a dye image from the thermal transfer image-receiving sheet can be ensured or improved to provide a high-density image even when the object is formed of glass, ceramic, or plastic, it is preferred to previously form a layer of a specific dyable resin on the surface of the object.

Such a resin is preferably one composed mainly of an epoxy resin or a modified epoxy resin, and examples thereof include bisphenol A epoxy resin, bisphenol S epoxy resin, phenolic novolak epoxy resin, cresol novolak epoxy resin, brominated epoxy resin, and styrene-modified epoxy resin.

The surface layer is formed of the above resin which has been cured with a curing agent, for example, an amine compound, an acid anhydride compound, phenolic resin, amino resin, a mercaptan compound, dicyandiamide, or a Lewis acid complex compound.

The thickness of the surface layer of the above resin formed on the surface of the object may be such as will be able to successfully receive a dye and generally about 0.5 to 20 $\mu$m.

The provision of such a resin layer on the object at least in its surface portion onto which a dye image is transferred suffices for attaining the contemplated object.

EXAMPLES

The following examples further illustrate the present invention but are not intended to limit it.

In the examples, "parts" are by weight.

Example I-1

A 6 $\mu$m-thick polyethylene terephthalate film, the back side of which had been treated for imparting a heat resisting property, was prepared as a support, and a coating solution, for a dye-holding layer, having the following composition was coated by gravure coating on one surface of the support at a coverage of 1.0 g/m$^2$ on a dry basis, and the resultant coating was dried to prepare a thermal transfer sheet.

Thermal transfer sheets with layers holding respective color dyes coated thereon were successively connected to one another to form an identical plane.

Coating Solution for Dye-holding Layer

| | |
|---|---|
| (A) Yellow component | |
| Dye of formula 1 | 3 parts |
| Polyvinyl acetoacetal resin (KS-5, manufactured by Sekisui Chemical Co., Ltd.) | 4.5 parts |
| Solvent (toluene/methyl ethyl ketone = 1/1) | 90 parts |
| (B) Magenta component | |
| Dye of formula 3 | 1 part |
| Dye of formula 4 | 1 part |
| Dye of formula 5 | 1 part |
| Polyvinyl acetoacetal resin (KS-5, manufactured by Sekisui Chemical Co., Ltd.) | 4.5 parts |
| Solvent (toluene/methyl ketone = 1/1) | 90 parts |
| (C) Cyan component | |
| Dye of formula 6 | 3 parts |
| Polyvinyl acetoacetal resin (KS-5, manufactured by Sekisui Chemical Co., Ltd.) | 4.5 parts |
| Solvent (toluene/methyl ethyl ketone = 1/1) | 90 parts |

Example I-2

A thermal transfer sheet was prepared in the same manner as in Example I-1, except that the following dyes were used as the yellow component.

| | |
|---|---|
| (A) Yellow component | |
| Dye of formula 1 | 1.5 parts |
| Dye of formula 2 | 1.5 parts |

Comparative Example I-1

A thermal transfer sheet was prepared in the same manner as in Example I-1, except that the dyes for respective color components were as follows.

| | |
|---|---|
| (A) Yellow component | |
| Dye of formula 1 | 3 parts |
| (B) Magenta component | |
| Dye of formula 3 | 3 parts |
| (C) Cyan component | |
| Dye of formula 6 | 3 parts |

Comparative Example I-2

A thermal transfer sheet was prepared in the same manner as in Example I-1, except that the dyes for yellow and magenta components were as follows.

| | |
|---|---|
| (A) Yellow component | |
| Dye of formula 2 | 3 parts |
| (B) Magenta component | |
| Dye of formula 4 | 3 parts |

Comparative Example I-3

A thermal transfer sheet was prepared in the same manner as in Example I-1, except that the dyes for respective color components were as follows.

| | |
|---|---|
| (A) Yellow component | |
| Dye of formula 1 | 3 parts |
| Dye of formula 3 | 0.03 part |
| (B) Magenta component | |
| Dye of formula 4 | 1.5 part |
| Dye of formula 5 | 1.5 part |
| Dye of formula 2 | 0.03 part |
| (C) Cyan component | |
| Dye of formula 6 | 3 parts |
| Dye of formula 3 | 0.03 part |

Formation of Image on Mug

Dyes were transferred from the thermal transfer sheets prepared in the above examples and comparative examples by means of a video printer (VY-200, manufactured by Hitachi, Ltd.) to a commercially available thermal transfer image-receiving sheet (Paper Ink VY-SX100, manufactured by Hitachi, Ltd.) to form a dye image on the image-receiving sheet. In this case, 16-step gray scale images and a full-color portrait image were used as originals for transfer.

Subsequently, the image on the thermal transfer image-receiving sheet was transferred to a mug using a transfer machine for a mug (Mugpress, manufactured by Express, U.S.A.). The transfer operation was carried out under conditions of temperature 177° C. (350° F.), gauge pressure 3, and transfer time 3 minutes.

Evaluation of Transferred Dye Images

Dye images produced by transfer of dyes to thermal transfer image-receiving sheets and mugs were evaluated for color reproduction and image density. The evaluation of the color reproduction was carried out by comparing the color of the original with that of the transferred image with the naked eye. The image density was evaluated by measuring the density of the darkest portion (the 16th step image) among the gray scale images with Macbeth reflection densitometer RD-918. The results are given in Table 1.

TABLE 1

| Example No. | Thermal transfer image-receiving sheet | | Mug | |
|---|---|---|---|---|
| | Color reproduction | Image density | Color reproduction | Image density |
| Ex. I-1 | Faithful to original | 2.5 | Faithful to original and image on thermal transfer image-receiving sheet | 1.8 |
| Ex. I-2 | do. | 2.3 | do. | 1.5 |
| Comp. Ex. I-1 | Unfaithful to original | 2.4 | Unfaithful to original and image on thermal transfer image-receiving sheet | 1.0 |
| Comp. Ex. I-2 | Faithful to original | 1.8 | Faithful to original and image on thermal transfer image-receiving sheet | 1.1 |
| Comp. Ex. I-3 | do. | 1.8 | do. | 1.0 |

Example II-1

A laminate prepared by laminating synthetic paper having in its interior microvoids (FPU-60, manufactured by Oji-Yuka Synthetic Paper Co., Ltd.) by the conventional dry lamination on both sides of coat paper (Saten-Kinfuji, manufactured by New Oji Paper Co., Ltd.; basis weight: 84.9 g/m$^2$) as a core material was provided as a substrate sheet. A coating solution, for a dye release layer, having the following composition was coated by bar coating on one side of the substrate sheet at a coverage of 0.7 g/m$^2$ on a dry basis, and the resultant coating was dried to form a dye release layer. Then, a coating solution, for a dye-receptive layer, having the following composition was coated by bar coating on the dye release layer at a coverage of 1.5 g/m$^2$ on a dry basis, and the resultant coating was dried to prepare a thermal transfer image-receiving sheet.

Coating Solution for Dye Release Layer

| | |
|---|---|
| Polyvinyl pyrrolidone resin (PVP K-90, manufactured by ISP) | 10 parts |
| Isopropyl alcohol | 90 parts |

Coating Solution for Dye-receptive Layer

| | |
|---|---|
| Vinyl chloride/vinyl acetate copolymer (#1000A, manufactured by Denki Kagaku Kogyo K.K.) | 20 parts |
| Amino-modified silicone (KF-393, manufactured by Shin-Etsu Chemical Co., Ltd.) | 4 parts |
| Epoxy-modified silicone (X-22-343, manufactured by Shin-Etsu Chemical Co., Ltd.) | 4 parts |
| Toluene | 40 parts |
| Methyl ethyl ketone | 40 parts |

Example II-2

A thermal transfer image-receiving sheet was prepared in the same manner as in Example II-1, except that the following coating solution was used for forming the dye release layer.

Coating Solution for Dye Release Layer

| | |
|---|---|
| Methyl vinyl ether/maleic anhydride copolymer (Gantrez AN-169, Inanufactured by ISP) | 10 parts |
| Isopropyl alcohol | 20 parts |
| Water | 70 parts |

Example II-3

A thermal transfer image-receiving sheet was prepared in the same manner as in Example II-1, except that the following coating solution was used for forming the dye release layer.

Coating Solution for Dye Release Layer

| | |
|---|---|
| Water-soluble acrylic resin (Jurymer SP-65T, manufactured by Nihon Junyaku Co., Ltd.) | 10 parts |
| Isopropyl alcohol | 20 parts |
| Water | 70 parts |

Example II-4

A thermal transfer image-receiving sheet was prepared in the same manner as in Example II-1, except that the following coating solution was used for forming the dye release layer.

Coating Solution for Dye Release Layer

| | |
|---|---|
| Cellulosic water-soluble resin (HEC SP-200, manufactured by Daicel Chemical Industries, Ltd.) | 10 parts |
| Isopropyl alcohol | 10 parts |
| Water | 80 parts |

Example II-5

A thermal transfer image-receiving sheet was prepared in the same manner as in Example II-1, except that the following coating solution was coated on the surface of the substrate sheet remote from the dye-receptive layer at a coverage of 1.5 g/m$^2$ on a dry basis.

Coating Solution for Heat Resisting Back Surface Layer

| | |
|---|---|
| Cellulose acetate resin (L-70, manufactured by Daicel Chemical Industries, Ltd.) | 5 parts |
| Methyl ethyl ketone | 70 parts |
| Methyl isobutyl ketone | 25 parts |

Comparative Example II-1

A thermal transfer image-receiving sheet was prepared in the same manner as in Example II-1, except that, instead of the dye release layer, a primer layer was provided by coating a coating solution having the following composition at a coverage of 0.7 g/m$^2$ on a dry basis.

Coating Solution for Primer Layer

| | |
|---|---|
| Urethane resin (N-5137, manufactured by Nippon Polyurethane Industry Co., Ltd.) | 10 parts |
| Methyl ethyl ketone | 45 parts |
| Toluene | 45 parts |

Comparative Example II-2

A thermal transfer image-receiving sheet was prepared in the same manner as in Example II-1, except that, instead of the dye release layer, a primer layer was provided by coating a coating solution having the following composition at a coverage of 0.7 g/m$^2$ on a dry basis.

Coating Solution for Primer Layer

| | |
|---|---|
| Polyester resin (Vylon 200, manufactured by Toyobo Co., Ltd.) | 10 parts |
| Methyl ethyl ketone | 45 parts |
| Toluene | 45 parts |

Thermal Transfer Sheet

A 6 $\mu$m-thick polyethylene terephthalate film, the back side of which had been treated for imparting a heat resisting property, was prepared as a support, and a coating solution, for a dye-holding layer, having the following composition was coated by gravure coating on one surface of the support at a coverage of 1.0 g/m$^2$ on a dry basis, and the resultant coating was dried to prepare thermal transfer sheet A.

Thermal transfer sheets with layers holding respective color dyes coated thereon were successively connected to one another to form an identical plane.

Coating Solution for Dye-holding Layer

| | | |
|---|---|---|
| (A) | Yellow component | |
| | Dye of formula 2 | 3.2 parts |
| | Dye of the following formula (i) | 4.8 parts |
| | Polyvinyl acetoacetal resin (KS-5, manufactured by Sekisui Chemical Co., Ltd.) | 3.5 parts |
| | Solvent (toluene/methyl ethyl ketone = 1/1) | 70 parts |

-continued

| | | |
|---|---|---|
| (B) | Magenta component | |
| | Dye of the following formula (ii) | 2.6 parts |
| | Dye of formula 4 | 3.4 parts |
| | Dye of formula 5 | 2.3 parts |
| | Polyvinyl acetoacetal resin (KS-5, manufactured by Sekisui Chemical Co., Ltd.) | 3.5 parts |
| | Solvent (toluene/methyl ethyl ketone = 1/1) | 70 parts |
| (C) | Cyan component | |
| | Dye of the following formula (iii) | 3.1 parts |
| | Dye of the following formula (iv) | 1.5 parts |
| | Dye of formula 6 | 3.1 parts |
| | Polyvinyl acetoacetal resin (KS-5, manufactured by Sekisui Chemical Co., Ltd.) | 3.5 parts |
| | Solvent (toluene/methyl ethyl ketone = 1/1) | 70 parts |

(i)

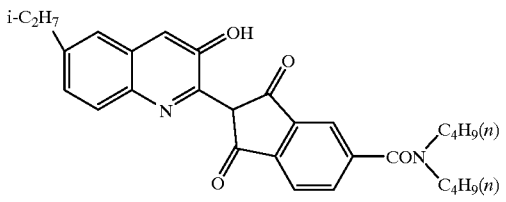

(ii)

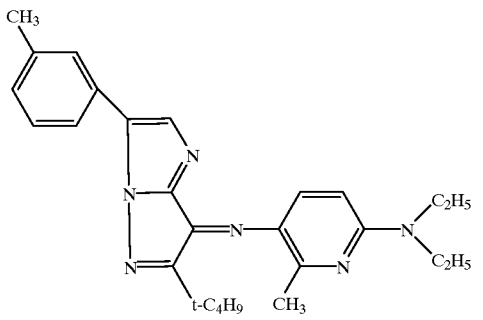

(iii)

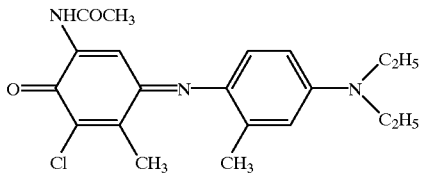

(iv)

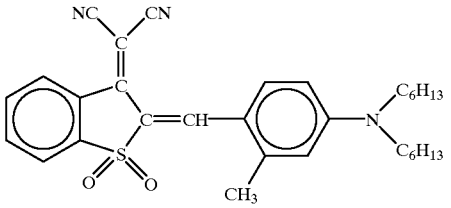

Mug

A commercially available ceramic mug was immersed in the following resin composition, and the resultant coating was heat-cured at 150° C. for 10 minutes to form a 10 $\mu$m-thick epoxy resin layer on the outer surface of the mug.

| | |
|---|---|
| Bisphenol A epoxy resin (Epicort YD8125, manufactured by Tohto Kasei Co., Ltd.) | 100 parts |
| | 100 parts |
| Polyamide curing agent (Goodmide G700, manufactured by Tohto Kasei Co., Ltd.) | 25 parts |

Formation of Image on Mug

Dyes were transferred from the above thermal transfer sheet A by means of a video printer (VY-200, manufactured by Hitachi, Ltd.) to the thermal transfer image-receiving sheets prepared in the above examples and comparative examples to form dye images on the thermal transfer image-receiving sheets. In this case, 16-step gray scale images were used as the original.

Subsequently, the thermal transfer image-receiving sheet with a dye image transferred thereto was press-contacted with the above mug, and heating was carried out under pressure at 140° C. for 2 minutes and at 170° C. for 2 minutes, thereby transferring the dye image to the mug.

Evaluation of Transferred Dye Images

The density of the darkest portion (the 16th step image) among the gray scale images transferred to the mug as an object was measured with Macbeth reflection densitometer RD-918. The results are given in Table 2.

TABLE 2

| | Image density |
|---|---|
| Ex. II-1 | 2.5 |
| Ex. II-2 | 2.3 |
| Ex. II-3 | 2.2 |
| Ex. II-4 | 2.2 |
| Ex. II-5 | 2.4 |
| Comp. Ex. II-1 | 1.9 |
| Comp. Ex. II-2 | 1.9 |

Example II-6

A resin coated paper prepared by providing a 30 $\mu$m-thick coating of a 1:1 mixture of a medium density polyethylene and a low density polyethylene onto both sides of coat paper (Saten-Kinfuji, manufactured by New Oji Paper Co., Ltd.; basis weight: 84.9 g/m$^2$) as a core material by melt extrusion was prepared as a substrate sheet. A coating solution, for a dye release layer, having the following composition was coated by bar coating on one side of the substrate sheet at a coverage of 1.5 g/m$^2$ on a dry basis, and the resultant coating was dried to form a dye release layer. Then, a coating solution, for a dye-receptive layer, having the following composition was coated by bar coating on the dye release layer at a coverage of 3 g/m$^2$ on a dry basis, and the resultant coating was dried to prepare a thermal transfer image-receiving sheet.

Coating Solution for Dye Release Layer

| | |
|---|---|
| Acrylic resin having polar group (antistatic resin) (Jurymer SP-65T, manufactured by Nihon Junyaku Co., Ltd.) | 20 parts |
| Isopropyl alcohol | 80 parts |

Coating Solution for Dye-receptive Layer

| | |
|---|---|
| Vinyl chloride/vinyl acetate/vinyl alcohol copolymer (#1000 GK, manufactured by Denki Kagaku Kogyo K.K.) | 50 parts |
| Polyester resin (Vylon 600, manufactured by Toyobo Co., Ltd.) | 50 parts |

-continued

| | |
|---|---|
| Titanate chelating agent $[(C_3H_7O)_2Ti(C_5H_7O_2)_2]$ | 10 parts |
| Epoxy-modified silicone (X-22-343, manufactured by Shin-Etsu Chemical Co., Ltd.) | 5 parts |
| Methyl ethyl ketone/toluene (1:1) | 400 parts |

Example II-7

A thermal transfer image-receiving sheet was prepared in the same manner as in Example II-6, except that the following coating solution was used for forming the dye release layer.

Coating Solution for Dye Release Layer

| | |
|---|---|
| Acrylic resin having polar group (antistatic resin) (Elecond PQ-50B, manufactured by Soken Chemical Engineering Co., Ltd.) | 50 parts |
| Methanol | 20 parts |

Example II-8

A thermal transfer image-receiving sheet was prepared in the same manner as in Example II-6, except that the following coating solution was used for forming the dye release layer.

Coating Solution for Dye Release Layer

| | |
|---|---|
| Acrylic resin having polar group (antistatic resin)(Jurymer SP-65T, manufactured by Nihon Junyaku Co., Ltd.) | 10.0 parts |
| Polyvinyl alcohol (Gosenol C-500, manufactured by Nippon Synthetic Chemical Industry) | 3.4 parts |
| Isopropyl alcohol | 40.0 parts |
| Water | 46.6 parts |

Example II-9

A thermal transfer image-receiving sheet was prepared in the same manner as in Example II-6, except that the following coating solution was used for forming the dye release layer.

Coating Solution for Dye Release Layer

| | |
|---|---|
| Polyvinyl alcohol (Gosenol C-500, manufactured by Nippon Synthetic Chemical Industry) | 6.8 parts |
| Water | 93.2 parts |

Example II-10

A thermal transfer image-receiving sheet was prepared in the same manner as in Example II-6, except that the following coating solution was used for forming the dye-receptive layer.

Coating Solution for Dye-receptive Layer

| | |
|---|---|
| Vinyl chloride/vinyl acetate copolymer (#1000GK, manufactured by Denki Kagaku Kogyo K.K.) | 50 parts |
| Polyester resin (Vylon 200 manufactured by Toyobo Co., Ltd.) | 50 parts |
| Epoxy-modified silicone (X-22-343, manufactured by Shin-Etsu Chemical Co., Ltd.) | 5 parts |
| Methyl ethyl ketone/toluene (1:1) | 400 parts |

Comparative Example II-3

A thermal transfer image-receiving sheet was prepared in the same manner as in Example II-6, except that no dye release layer was provided.

Comparative Example II-4

A thermal transfer image-receiving sheet was prepared in the same manner as in Example II-6, except that the following coating solution was used for forming the dye release layer.

Coating Solution for Dye Release Layer

| | |
|---|---|
| Polyester resin (Vylon 200, manufactured by Toyobo Co., Ltd.) | 20 parts |
| Methyl ethyl ketone/toluene (1:1) | 80 parts |

Thermal Transfer Sheet

Thermal Transfer Sheet B

A 6 μm-thick polyethylene terephthalate film, the back side of which had been treated for imparting a heat resisting property, was prepared as a support, and a coating solution, for a dye-holding layer, having the following composition was coated by gravure coating on one surface of the support at a coverage of 1.0 g/m$^2$ on a dry basis, and the resultant coating was dried to prepare a thermal transfer sheet B.

Thermal transfer sheets with layers holding respective color dyes coated thereon were successively connected to one another to form an identical plane.

Coating Solution for Dye-holding Layer

| | |
|---|---|
| (A) Yellow component | |
| Dye of formula 1 | 3 parts |
| Polyvinyl acetoacetal resin (KS-5, manufactured by Sekisui Chemical Co., Ltd.) | 4.5 parts |
| Solvent (toluene/methyl ethyl ketone = 1/1) | 90 parts |
| (B) Magenta component | |
| Dye of formula 3 | 1 part |
| Dye of formula 4 | 1 part |
| Dye of formula 5 | 1 part |
| Polyvinyl actoacetal resin (KS-5, manufactured by Seiksui Chemical Co., Ltd.) | 4.5 parts |
| Solvent (toluene/methyl ethyl ketone = 1/1) | 90 parts |
| (C) Cyan component | |
| Dye of formula 6 | 3 parts |
| Polyvinyl acetoacetal resin (KS-5, manufactured by Seikisui Chemical Co., Ltd. | 4.5 parts |
| Solvent (toluene/methyl ethyl ketonw = 1/1) | 90 parts |

Thermal Transfer Sheet C

Thermal transfer sheet C was prepared in the same manner as described above in connection with the preparation of thermal transfer sheet B, except that the following yellow component was used.

Coating Solution of Dye-holding Layer

| | |
|---|---|
| (A) Yellow component | |
| Dye of formula 1 | 1.5 parts |
| Dye of formula 2 | 1.5 parts |

Mug

A commercially available ceramic mug was immersed in the following resin composition, and the resultant coating was heat-cured at 150° C. for 10 minutes to form a 10 μm-thick epoxy resin layer on the outer surface of the mug.

| | |
|---|---|
| Bisphenol A epoxy resin (Epicort YD8125, manufactured by Tohto Kasei Co., Ltd.) | 100 parts |
| Polyamide curing agent (Goodmide G700, manufactured by Tohto Kasei Co., Ltd.) | 25 parts |

Formation of Image on Mug

Dyes were transferred by means of a video printer (VY-200, manufactured by Hitachi, Ltd.) from the above thermal transfer sheet to the thermal transfer image-receiving sheets prepared in the above examples and comparative examples to form dye images on the thermal transfer image-receiving sheets. In this case, 16-step gray scale images were used as the original for transfer.

Subsequently, the thermal transfer image-receiving sheet with a dye image transferred thereto was press-contacted with the above mug, and heating was carried out under pressure at 200° C. for 3 minutes, thereby transferring the dye image to the mug.

Combinations of thermal transfer sheets with thermal transfer image-receiving sheets used for the above image forming test are listed in the following Table 3.

TABLE 3

| Thermal transfer sheet | Thermal transfer image-receiving sheet |
|---|---|
| C | Ex. II-6 |
| B | Ex. II-7 |
| B | Ex. II-8 |
| B | Ex. II-9 |
| B | Ex. II-10 |
| B | Comp. Ex. II-3 |
| B | Comp. Ex. II-4 |

Evaluation of Transferred Image

The density of the dye images transferred to the mug as an object was evaluated by visual inspection. The results are given in Table 4.

TABLE 4

| Example No. | Dye image density |
|---|---|
| Ex. II-6 | ○ |
| Ex. II-7 | ○ |
| Ex. II-8 | ○ |
| Ex. II-9 | ○ |

TABLE 4-continued

| Example No. | Dye image density |
|---|---|
| Ex. II-10 | ○ |
| Comp. Ex. II-3 | X |
| Comp. Ex. II-4 | X |

Note: ○ . . . high density
X . . . low density

What is claimed is:

1. A thermal transfer sheet for forming an image on an object, comprising a support and, provided thereon, at least a yellow dye-holding layer, a magenta dye-holding layer, and a cyan dye-holding layer, said dye-holding layers each comprising a thermal transfer dye and a binder resin, said yellow dye-holding layer comprising as the thermal transfer dye a dye represented by the following formula 1 and/or a dye represented by the following formula 2, said magenta dye-holding layer comprising as the thermal transfer dye a dye represented by the following formula 3 and at least one dye selected from those represented by the following formulae 4 and 5, said cyan dye-holding layer comprising as the thermal transfer dye a dye represented by the following formula 6:

Formula 1

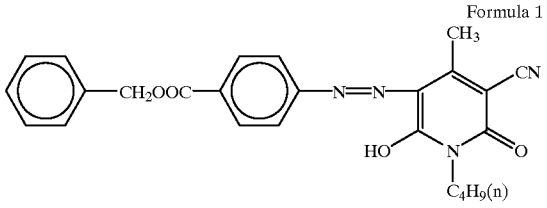

Formula 2

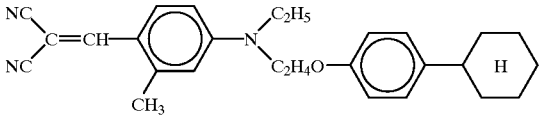

-continued

Formula 3

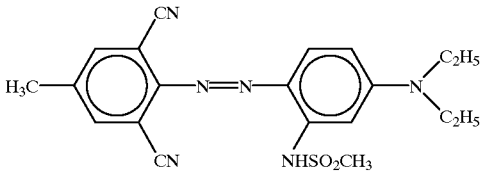

Formula 4

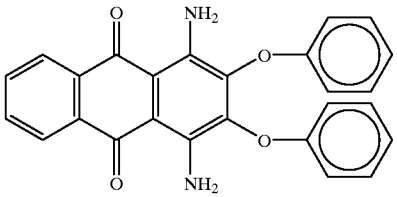

Formula 5

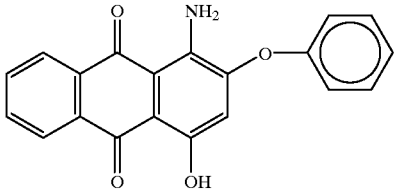

Formula 6

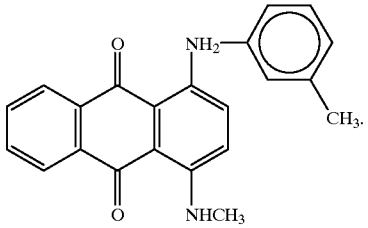

2. The thermal transfer sheet according to claim 1, wherein said support is a polyethylene terephthalate film.

3. The thermal transfer sheet according to claim 1, which further comprises an anti-tack layer provided on the surface of the dye-holding layer remote from the support.

4. The thermal transfer sheet according to claim 1, which further comprises a lubricious layer provided on the surface of the support remote from the dye-holding layer.

* * * * *